US010099806B2

(12) United States Patent
Koike et al.

(10) Patent No.: US 10,099,806 B2
(45) Date of Patent: Oct. 16, 2018

(54) DRUG CASSETTE AND DRUG PACKAGING DEVICE

(71) Applicant: YUYAMA MFG. CO., LTD., Toyonaka-shi, Osaka (JP)

(72) Inventors: Naoki Koike, Toyonaka (JP); Katsunori Yoshina, Toyonaka (JP)

(73) Assignee: YUYAMA MFG. CO., LTD., Toyonaka-shi (JP)

( * ) Notice: Subject to any disclaimer, the term of this patent is extended or adjusted under 35 U.S.C. 154(b) by 202 days.

(21) Appl. No.: 15/022,908

(22) PCT Filed: Sep. 17, 2014

(86) PCT No.: PCT/JP2014/074459
§ 371 (c)(1),
(2) Date: Mar. 17, 2016

(87) PCT Pub. No.: WO2015/041220
PCT Pub. Date: Mar. 26, 2015

(65) Prior Publication Data

US 2016/0229564 A1 Aug. 11, 2016

(30) Foreign Application Priority Data

Sep. 18, 2013 (JP) ..... 2013-193122

(51) Int. Cl.
*B65B 1/10* (2006.01)
*A61J 7/00* (2006.01)
(Continued)

(52) U.S. Cl.
CPC ..... *B65B 1/10* (2013.01); *A61J 7/0076* (2013.01); *A61J 7/0409* (2013.01); *B65B 57/14* (2013.01); *G07F 17/0092* (2013.01)

(58) Field of Classification Search
CPC ..... B65B 1/10; B65B 57/14; A61J 7/0076; A61J 7/0409; G07F 17/0092
See application file for complete search history.

(56) References Cited

U.S. PATENT DOCUMENTS 6,170,229 B1 * 1/2001 Kim ..... B65B 35/56 221/265
6,471,093 B1 * 10/2002 Kodama ..... B65G 47/1457 221/266

(Continued)

FOREIGN PATENT DOCUMENTS

EP 2345399 A1 7/2011
JP H1-51403 B2 11/1989

(Continued)

OTHER PUBLICATIONS

ISA/JP, International Search Report dated Jan. 6, 2015, International Application No. PCT/JP2014/074459, Total 4 pages with English translation.

(Continued)

*Primary Examiner* — Patrick H Mackey
(74) *Attorney, Agent, or Firm* — Masuvalley & Partners

(57) ABSTRACT

Embodiments of the present invention provide a drug cassette having a compact configuration which allows for drugs to be fed out one at a time using a first rotating body and a second rotating body, and also provide a drug packaging device. The following are arranged within a cassette main body of said drug cassette: a cylindrical body that accommodates the drugs; a first rotating body that is disposed on a bottom surface side of the cylindrical body, the first rotating body being rotatable around a first rotating shaft; and a second rotating body that is disposed on an outer periphery of an opening in the cylindrical body, the second rotating body being rotatable around a second rotating shaft. At least one drive unit, disposed in a remaining space within (Continued)

the cassette main body, to rotate and drive the first rotating body and the second rotating body.

9 Claims, 12 Drawing Sheets

(51) Int. Cl.

| | |
|---|---|
| ***A61J 7/04*** | (2006.01) |
| ***B65B 57/14*** | (2006.01) |
| ***G07F 17/00*** | (2006.01) |

(56) References Cited

U.S. PATENT DOCUMENTS

| | | | | |
|---|---|---|---|---|
| 9,242,785 | B2 * | 1/2016 | Yuyama | B65B 35/06 |
| 9,792,756 | B2 * | 10/2017 | Yuyama | G07F 17/0092 |
| 2010/0287880 | A1 * | 11/2010 | Yasunaga | A61J 7/0084 53/64 |
| 2011/0042404 | A1 * | 2/2011 | Koike | G07F 9/026 221/2 |
| 2011/0170655 | A1 * | 7/2011 | Yuyama | G07F 11/66 377/6 |
| 2011/0178634 | A1 * | 7/2011 | Yuyama | B65B 5/103 700/232 |
| 2013/0284755 | A1 * | 10/2013 | Yuyama | A61J 7/02 221/13 |
| 2015/0197391 | A1 * | 7/2015 | Yuyama | B65D 83/04 221/2 |
| 2016/0213571 | A1 * | 7/2016 | Takahama | A61J 3/00 |

FOREIGN PATENT DOCUMENTS

| | | | | |
|---|---|---|---|---|
| WO | 01/60726 | A1 | 8/2001 | |
| WO | 2012/099189 | A1 | 7/2012 | |
| WO | WO-2012099189 | A1 * | 7/2012 | A61J 7/02 |
| WO | 2013/015227 | A1 | 1/2013 | |
| WO | 2013/035692 | A1 | 3/2013 | |

OTHER PUBLICATIONS

EPO, Supplementary European Search Report dated May 2, 2017 in corresponding European Patent Application No. 14845534.8, 11 pages.

Japan Patent Office, Notice of Reason for Rejection(Office Action) dated Aug. 21, 2018 in Japanese Patent Application No. 2015-537929, total 7 pages with English Translation.

* cited by examiner

DRUG CASSETTE AND DRUG PACKAGING DEVICE

CROSS-REFERENCE TO RELATED APPLICATIONS

This application is the U.S. National Phase of International Patent Application No. PCT/JP2014/074459, filed on Sep. 17, 2014, and claims priority under 35 U.S.C. § 119 to Japanese Patent Application No. 2013-193122, filed on Sep. 18, 2013, which are hereby expressly incorporated by reference in their entirety for all purposes.

TECHNICAL FIELD

The present invention pertains to a drug cassette and a drug packaging device.

BACKGROUND ART

Conventionally, as devices for aligning and supplying small articles (goods), for example, a device provided with a disk-shaped first rotating body rotated by a first driving means, and a torus-shaped second rotating body rotated by a second driving means is known, as disclosed for example in Japanese Examined Patent Application Publication No. H1-51403.

However, even if the abovementioned conventional device is simply adopted as a mechanism for a drug cassette, a problem exists with determining how to lay out the constituent parts such as the disk drive mechanism, and in addition, configuring the device so as to be compact is difficult.

An object of the present invention is to provide a drug cassette having a compact configuration and capable of dispensing drugs one at a time through a first rotating body and a second rotating body, and a drug packaging device using the same.

SUMMARY OF THE INVENTION

As a means for solving the abovementioned problems, the present invention provides a drug cassette including a cylindrical body arranged in a cassette main body for accommodating drugs; and a second rotating body arranged on an outer periphery of an opening part of the cylindrical body in the cassette main body, and capable of rotating around a second rotating shaft; wherein a driving unit is arranged in a surplus space in the cassette main body for rotating and driving at least the first rotating body and the second rotating body.

Through this configuration, the surplus space of the cassette main body is effectively utilized, and the drug cassette can be achieved with a compact configuration.

The drug cassette may be further provided with a height regulator for regulating the height of the drugs to be conveyed by the second rotating body; wherein a drive mechanism for moving the height regulator is arranged in the surplus space of the cassette main body.

The drug cassette may be further provided with a width regulator for regulating the width of the drugs to be conveyed by the second rotating body; wherein a drive mechanism for moving the width regulator is arranged in the surplus space of the cassette main body.

The drug cassette may be further provided with a hopper for discharging the drugs to be conveyed by the second rotating body; wherein the hopper is arranged in the surplus space of the cassette main body.

The first rotating body is preferably provided with a plurality of ridges extending on a top surface from a rotating center side to an outer diameter side, and the ridges preferably have an inclination angle of a second inclined surface of a rotational direction side that is smaller compared to an inclination angle of a first inclined surface of a reverse side of the rotation direction.

The drug cassette is preferably further provided with a drug detection unit for detecting drugs to be discharged outside by rotation of the second rotating body; and a control unit for temporarily rotating the first rotating body in reverse direction when drugs are not detected by the drug detection unit even though the first rotating body and the second rotating body are being rotated.

The drug cassette is preferably further provided with a drug detection unit configured so as to be capable of detecting drugs tilted due to a center of gravity position being separated from the second rotating body.

The drug cassette preferably has a step part formed on an outer peripheral edge of the second rotating body and is preferably further provided with a presser piece for pressing the step part.

As a means for solving the abovementioned problems, the present invention also provides a drug packaging device provided with the drug cassette according to any one of the above-mentioned embodiments; a support base capable of attaching and detaching the drug cassette; and a packaging unit for packaging drugs dispensed from the drug cassette.

According to the embodiments of the present invention, a drive unit for rotating and driving at least the first rotating body and the second rotating body is arranged in the surplus space of the cassette main body, and therefore the drug cassette can be formed with a compact configuration.

BRIEF DESCRIPTION OF THE DRAWINGS

The present disclosure is described in conjunction with the appended figures.

DETAILED DESCRIPTION OF THE INVENTION

Embodiments of the present invention are described in detail below with reference to the attached drawings. Note that, in the description below, terminology which expresses a specific direction or position (such as, for example, "up", "down", "side", and "end") is used as necessary, but those terms are used in order to facilitate understanding of the invention with reference to the drawings, and the technical scope of the present invention is not limited by the meaning of those terms. Furthermore, the following description is essentially merely an illustrative example, and is not intended to limit the present invention, its applicable objects, or its applications.

Figure 1:
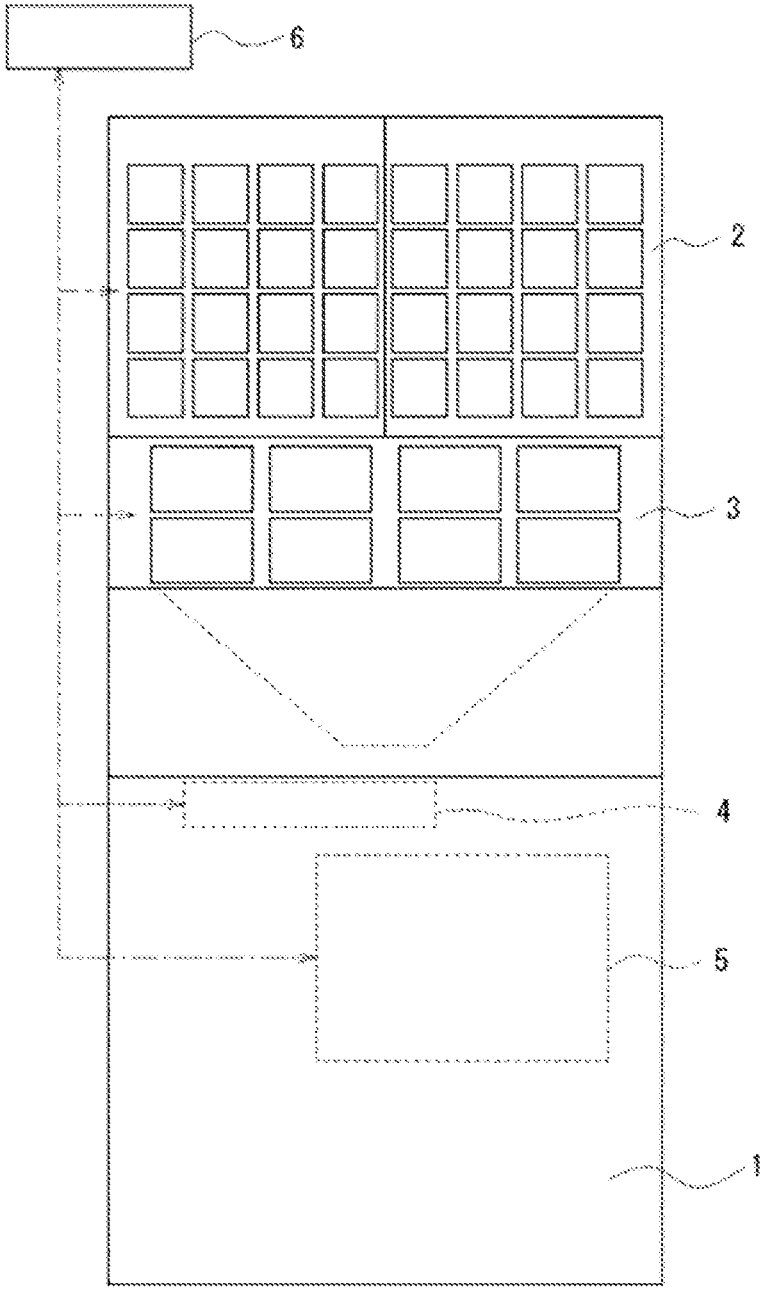
FIG. 1 is an elevation view showing an outline of a drug packaging device according to the present embodiment.

FIG. 1 illustrates a schematic view of an embodiment of a drug packaging device. The drug packaging device thereof is provided respectively, from top to bottom, with a plurality of first drug feeders 2, a plurality of second drug feeders 3, a hand distributed drug supply unit 4, and a packaging unit 5 in a packaging device main body 1. As shown in FIG. 1, a control unit 6 may drive and control all these components.

The first drug feeder 2 is a conventionally known feeder, where a plurality of the first drug feeders 2 are arranged vertically (from top to bottom) and horizontally (from left to right) within a top section of the packaging device main body 1. Each of the plurality of the first drug feeders 2 houses multiple drugs by drug type (hereinafter, if the description of drugs is provided, the drugs are primarily tablets, but shall also include capsules). A prescribed number of drugs is discharged from the relevant first drug feeder 2 based on prescription data and the like.

The second drug feeder 3 houses drugs with a low usage frequency, such as drugs for which the quantity must be counted, and the like. The details will be described later.

The hand distributed drug supply unit 4 is used when tablets which are cut in half or drugs with a low usage frequency are distributed by hand. In this case, the tablets are set in an area formed in a lattice shape and packaged by the packaging unit 5.

The packaging unit 5 unwinds and supplies packaging paper that has been wound into a roll, and packages, in single package portions, drugs that have been supplied from each of the first and second drug feeders 2, 3 or the hand distributed drug supply unit 4.

Figure 2:
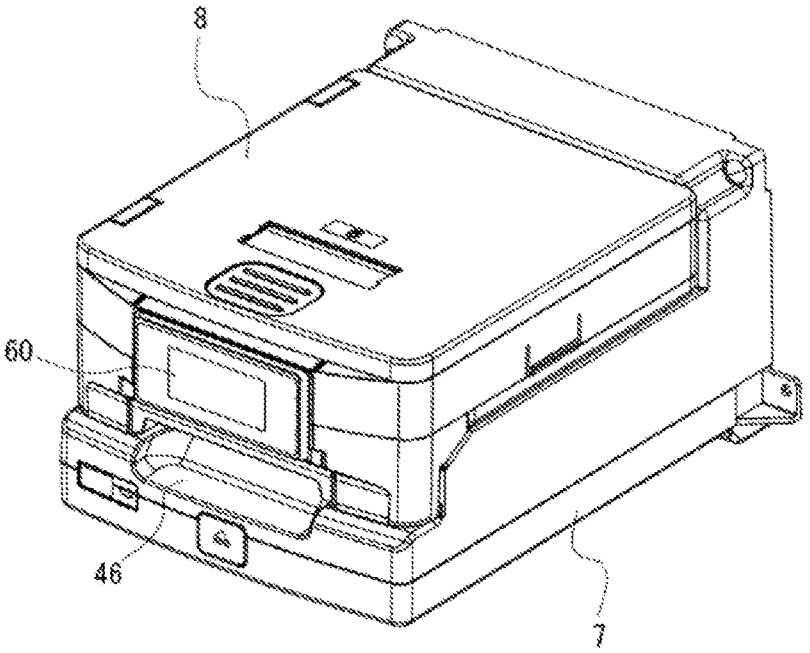
FIG. 2 is a perspective view of a second drug feeder shown in FIG. 1.
Figure 3A:
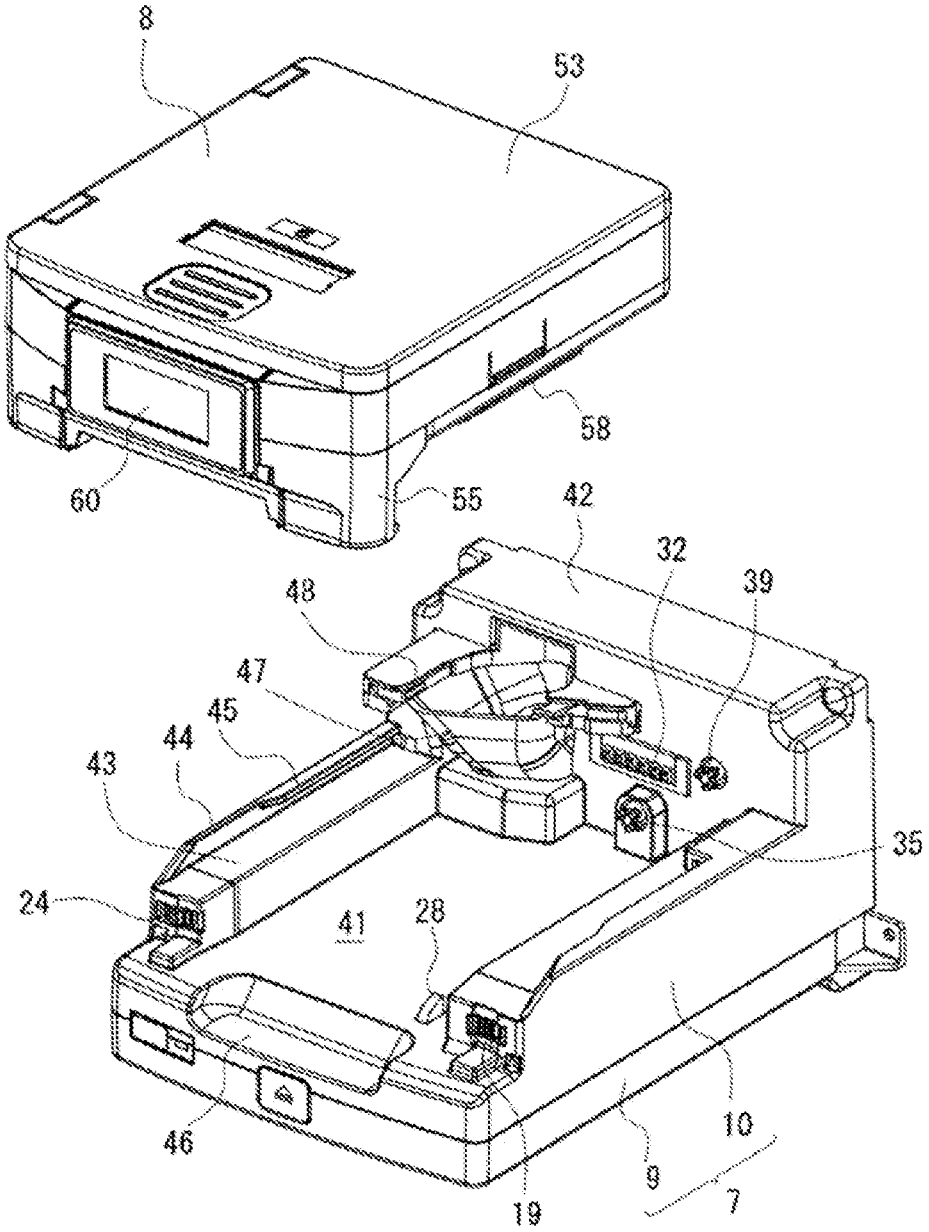
FIG. 3A is a perspective view showing a condition with the drug cassette removed from the support base of FIG. 2.

Next, the second drug feeder 3, which is a characteristic part of the present invention, is described in detail. The second drug feeders 3 are arranged in parallel at the front surface of the packaging device main body 1 in a manner with a top row and a bottom row, each having four feeders in the right and left direction. As shown in FIG. 2 and FIG. 3A, each of the second drug feeders 3 is configured from a support base 7, and a drug cassette 8 that can be attached to and detached from the support base 7.

Figure 4:
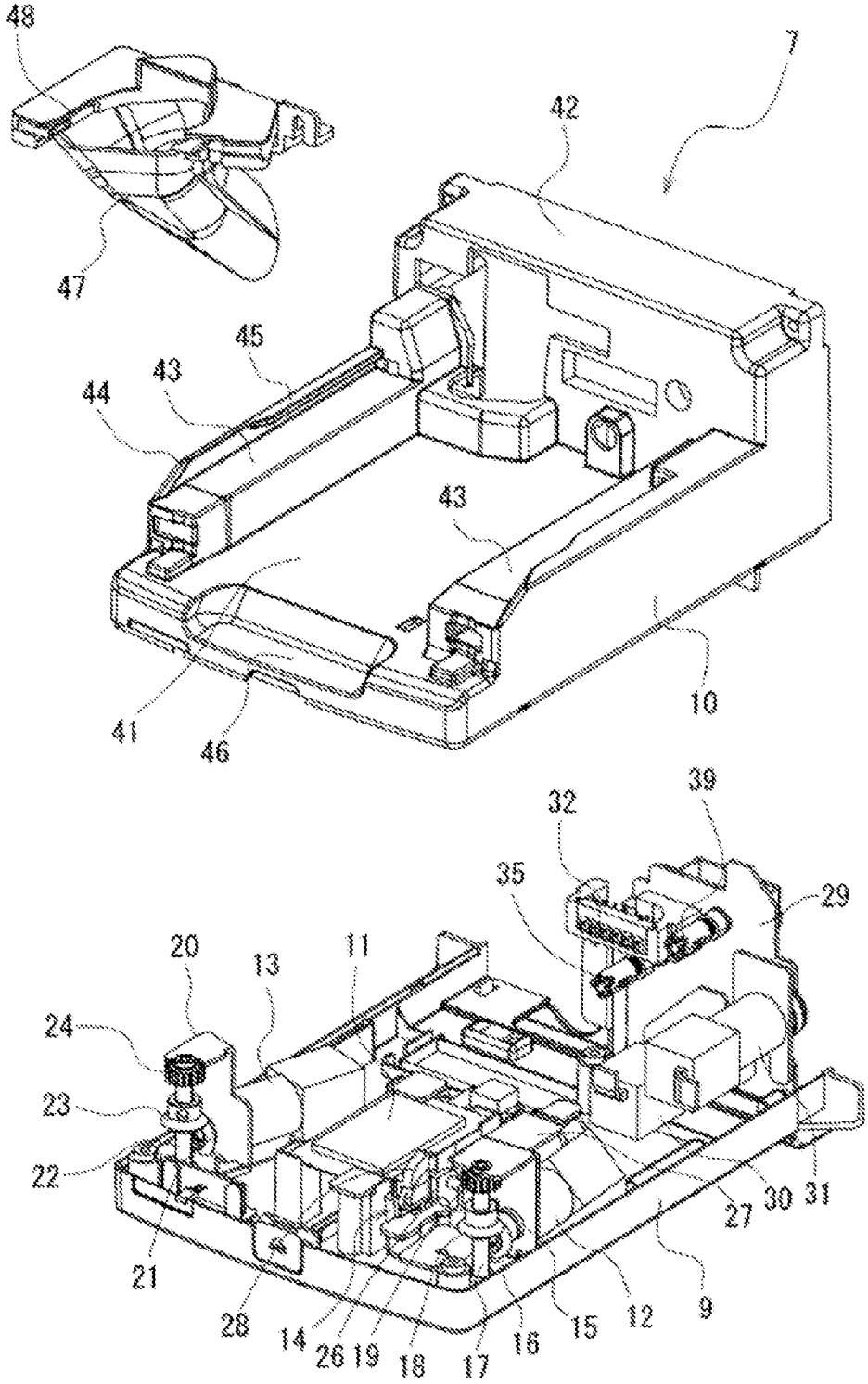
FIG. 4 is an exploded perspective view of the support base of FIG. 3A.
Figure 5:
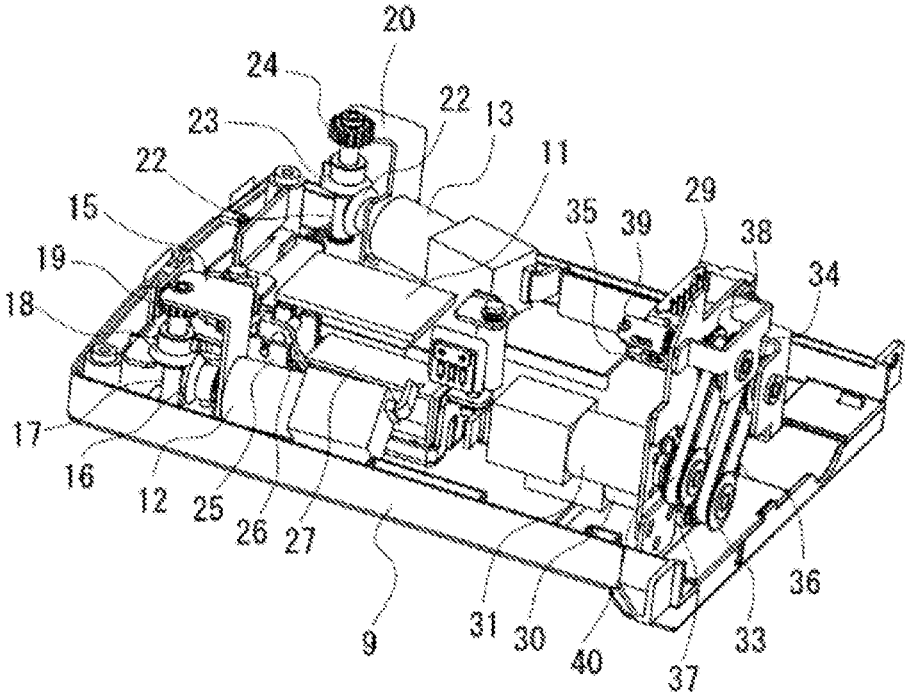
FIG. 5 is a perspective view showing the base main body of the support base of FIG. 4 as viewed from a different direction.

As shown in FIG. 4, the support base 7 is provided with a base main body 9, constituent parts such as a plurality of motors mounted to the base main body 9, and a base cover 10. The base main body 9 is a flat board shape made from a synthetic resin material. As shown in FIGS. 4-5, an RFID reader 11 is attached on a center part toward a front side of the base main body 9. The RFID reader 11 reads the RFID (Radio Frequency Identification) provided at the side of the drug cassette, and obtains information on the drug cassette 8 thereof and the type of drugs contained therein, and the like. Furthermore, a first motor 12, a second motor 13, and a cassette lock part 14 are disposed at both sides of the base main body 9.

The first motor 12 is fixed to a first supporting piece 15, which has a tip end part fixed to a corner part at one front end side of the base main body 9. The first supporting piece 15 is provided with a top surface part and a bottom surface part, which are opposing, and with a vertical surface part connecting the top and bottom surface parts. A rotating shaft of the first motor 12 pierces the vertical surface part, and a first bevel gear 16 is fixed to a tip end part of the rotating shaft. Furthermore, a first rotating shaft 17 is rotatably supported between the top and bottom surface parts of the first supporting piece 15. A second bevel gear 18 which meshes with the first bevel gear 16 is fixed at the center portion of the first rotating shaft 17, and at an upper portion, a first spur gear 19, which meshes with a spur gear 70*a* (see FIG. 6) of a height regulator 69, which is provided at the later-described drug cassette 8 side, is secured.

Like the first motor 12, the second motor 13 is fixed to a second supporting piece 20, which has the same configuration as the first supporting piece 15 and has a tip end part that is fixed to a corner part of the other front end side of the base main body 9. A third bevel gear 21 is fixed to the tip end of a rotating shaft of the second motor 13. A second rotating shaft 22 is rotatably supported between the top and bottom surfaces of the second supporting piece 20. A fourth bevel gear 23, which meshes with the third bevel gear 21, is fixed at a center part of the second rotating shaft 22, and at an upper portion thereof, a second spur gear 24, which meshes with a spur gear 72*b* (see FIG. 6) of a width regulator 71, which is provided at the later-described drug cassette 8 side, is secured.

The cassette lock part 14 is provided to lock the second drug cassette 8 mounted to the support base 7 such that it cannot fall out. The cassette lock part 14 has an operation piece 26, and a solenoid 27 for driving the operation piece 26 attached to an attachment piece 25, which is fixed to the support base 7. The operation piece 26 has a shaft part that is rotatably supported between opposing surfaces of the attachment piece 25, and a protruding piece 28 is movably attached to one end side. The protruding piece 28 is biased upward by a spring (not illustrated) arranged between the protruding piece 28 and the attachment piece 25. Furthermore, the other end part of the operation piece 26 is rotatably linked to a rod tip end of the solenoid 27. Through this, when the solenoid 27 is excited and driven, the operation piece 26 rotates, and the protruding piece 28 moves up and down and appears and disappears from a top surface of a bottom part 41, and engages and disengages with an interlocking concavity (not illustrated) formed at the bottom surface of the later-described drug cassette 8.

Furthermore, an attachment plate 29 extending vertically upward is fixed to the rear side of the base main body 9. A third motor 30, a fourth motor 31, and a charging unit 32 are attached to the attachment plate 29.

The third motor 30 has a tip end side that is fixed to the lower side of the attachment plate 29, and a first pulley 33 is fixed to the tip end part of a rotating shaft projecting therefrom. A rotating shaft having a second pulley 34 fixed to one end and a first driving gear 35 fixed to the other end is rotatably supported at the upper side of the attachment plate 29. A first belt 36 is extended between the first pulley 33 and the second pulley 34 such that the driving force of the third motor 30 is transmitted to the first driving gear 35. The first driving gear 35 meshes with a first driven gear 61 provided at the later-described drug cassette side, and is capable of rotating the first rotating body 51 in the forward and reverse directions.

Like the third motor 30, the fourth motor 31 has a tip end side that is fixed to the lower side of the attachment plate 29, and a third pulley 37 is fixed to a tip end part of the rotating shaft projecting therefrom. At the upper side of the attachment plate 29, a rotating shaft is rotatably supported with a fourth pulley 38 fixed at one end, and a second driving gear 39 fixed at the other end. A second belt 40 is extended between the third pulley 37 and the fourth pulley 38 such that the driving force of the fourth motor 31 is transmitted to the second driving gear 39. The second driving gear 39 meshes with a second-driven gear 64 provided at the later-described drug cassette side such that the second rotating body 52 can be rotated in the forward and reverse directions.

The charging unit 32 is configured of terminals and the like that enable power to be supplied to the drug cassette 8 side by mounting the drug cassette 8 to the support base 7 (for example, the charging unit 32 may be configured such that one of either the charging unit 32 on the drug cassette 8 side or on the support base 7 side is a male type terminal, and the remaining other is a female type terminal). Through this, when the drug cassette 8 is mounted to the support base 7, charging can be performed by supplying power to a battery (or capacitor) of the later-described drug cassette 8 side via the charging unit 32.

As shown in FIG. 4, the base cover 10 is configured by the bottom part 41 and a back surface part 42. A guide unit 43 extending to the front and back at both sides is formed at the bottom part 41. A cassette bottom part 54 of the later-described drug cassette 8 is guided by the inside surfaces of the guide unit 43. An auxiliary wall 44 is formed projecting further upward from the outside edge of the top surface of the guide unit 43. A guide receiving piece 45 projects to the inside from the auxiliary wall 44 such that a guide piece 58 formed at the cassette bottom part 54 of the drug cassette 8 is guided. As shown in FIG. 3A, part of the first spur gear 19 is exposed from the front end surface of the right side guide unit 43, and part of the second spur gear 24 is exposed from the front end surface of the left side guide unit 43. Furthermore, a depression part 46 is formed at the front end center of the bottom part 41 in order to simplify gripping of the front end part of the drug cassette 8. In addition, a slit-shaped opening is formed in the top surface of the bottom part 41 at a portion near the depression part 46, and the protruding piece 28 of the cassette lock part 14 can appear through and disappear from that opening.

Tip end parts (gear portions) of the first driving gear 35 and the second driving gear 39 are exposed from the back surface part 42. Moreover, a hopper 47 for guiding drugs dispensed from the drug cassette 8 is attached to the back surface part 42. Of course, the hopper 47 may also be fixed to the drug cassette 8. Furthermore, drugs discharged to the hopper 47 are detected by a discharge sensor 48 and counted.

Figure 3B:
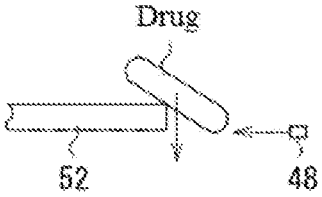
FIG. 3B is a schematic view showing a position for detecting drugs by a discharge sensor.

An optical sensor is used for the discharge sensor 48, and as shown in FIG. 3B, a light path is established further to the downward side by a prescribed dimension (for example, 1 mm) than the top surface of the second rotating body 52. In other words, by moving the center of gravity position of the drug from the top surface of the second rotating body 52 to a position at which the drug will drop, a position at which the drug is tilted can be detected. Through this, if the drug quantity is to be counted, rotation of the second rotating body 52 can be stopped at the point in time when the final drug is reliably discharged, and therefore discharge of the next drug can be reliably prevented.

Figure 6:
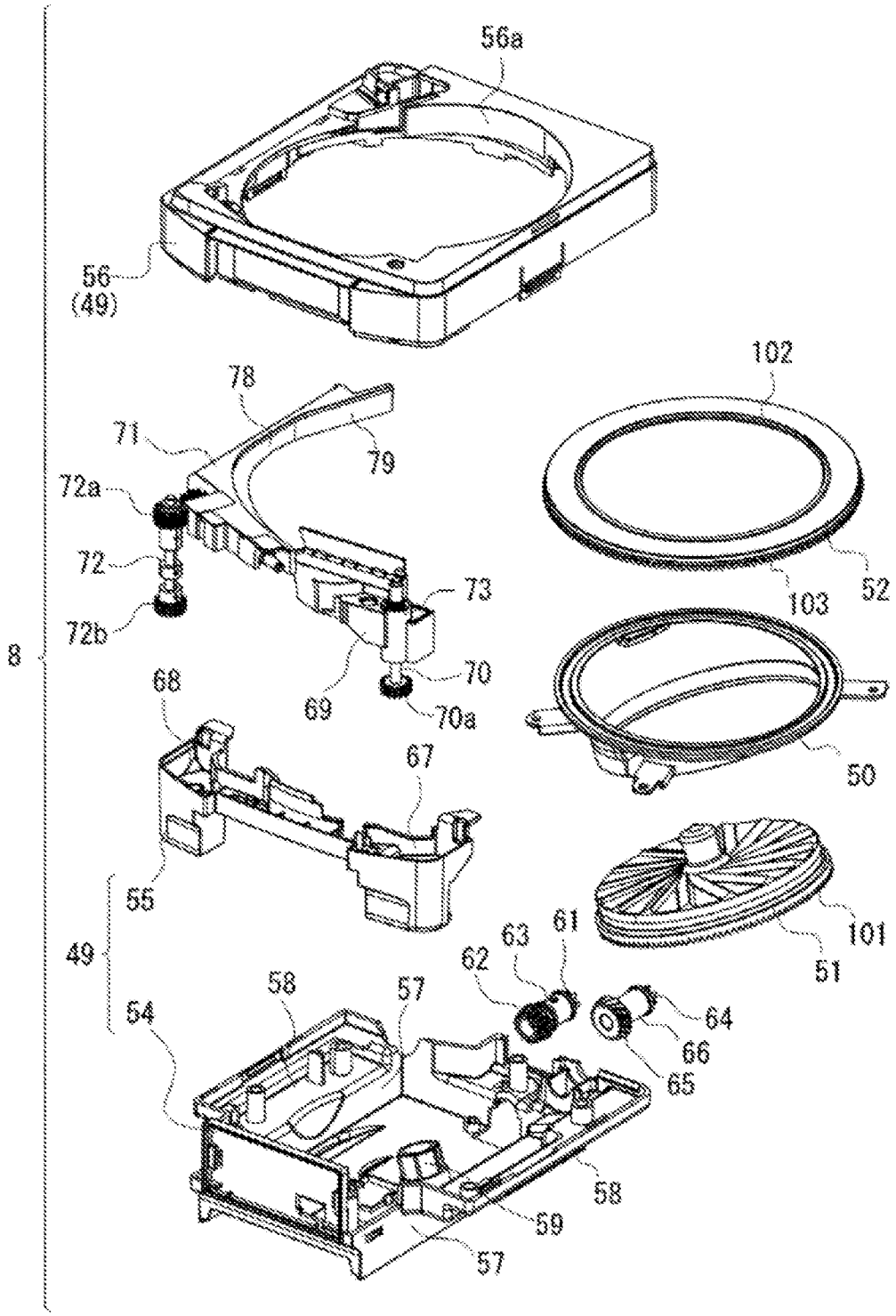
FIG. 6 is an exploded perspective view of the drug cassette of FIG. 2.

As shown in FIG. 6, the drug cassette 8 houses a cylindrical body 50 in a cassette main body 49, the first rotating body 51 is arranged at a lower end opening part of this cylindrical body 50, the second rotating body 52 is arranged at the outer periphery of the upper end opening part of the cylindrical body 50, and the upper opening part of the cassette main body 49 is closed by the lid body 53 (see FIG. 3A).

The cassette main body 49 is provided with a cassette bottom part 54, a cassette front end part 55, and a cassette torso 56.

Both side parts of the cassette bottom part 54 extend upward, and configure a side surface part 57 that is guided by the guide unit 43 of the support base 7. Furthermore, at the upper edge of the side surface part 57, the part extends further in the side direction, and the guide piece 58 is formed as the side edge part thereof. The guide piece 58 regulates movement in the upward direction using a guide receiving piece 45 formed at the base cover 10 of the support base 7. To the right of the center part of the bottom surface of the cassette bottom part 54, a cylindrical bearing part 59 projected at a slant is formed, and a rotating shaft 51*a* is rotatably supported at the bearing part 59.

Figure 7:
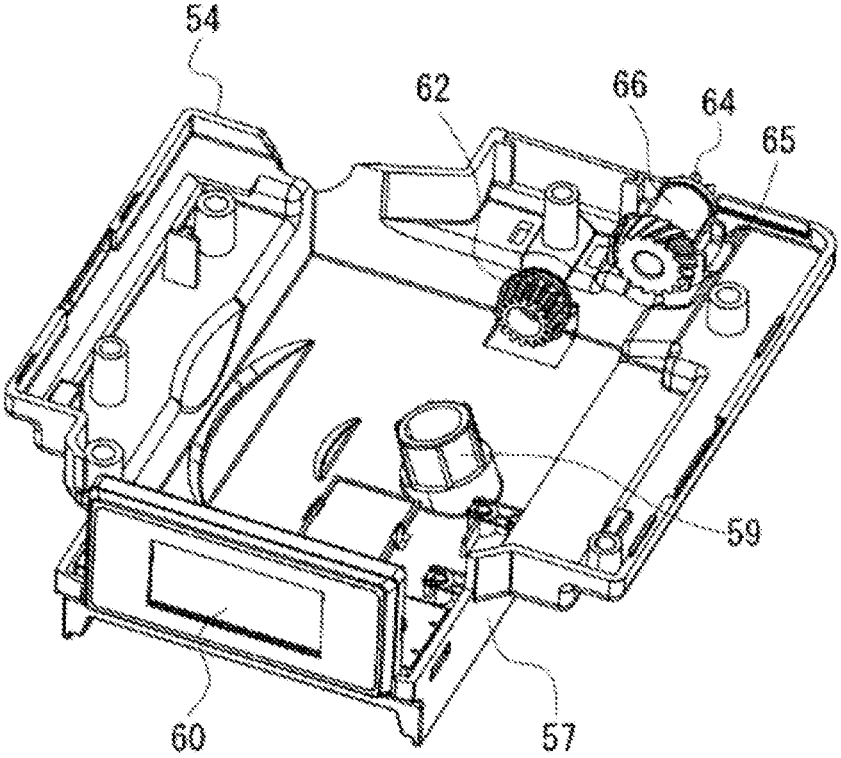
FIG. 7 is a perspective view showing the cassette bottom part of the drug cassette of FIG. 6.

As shown in FIG. 7, the front end portion of the cassette bottom part 54 extends upward such that a display panel 60 can be attached. Here, an electronic paper is used for the display panel 60. Electronic paper is media that requires power to rewrite the display details, but does not consume power in the display state. Furthermore, various display data such as the name and quantity of the drugs to be housed inside the drug cassette 8 based on the prescription data, and in some cases, the name of the patient, is input and displayed on the electronic paper. Through this, the user can know at one glance what drugs are contained in the drug cassette 8. Moreover, by displaying the name and quantity of the drugs in a rewritable manner, changes in drugs and the like can be flexibly accommodated. Furthermore, even when the drugs are to be replenished, the replenishment work can be implemented after confirming the details displayed on the electronic paper.

However, with electronic paper, even if display data is input, it takes some time for the display to be rewritten. Therefore, when a charging type battery (or capacitor) which is not illustrated is provided, and the drug cassette 8 is mounted to the support base 7, this battery (or capacitor) is charged. In this manner, even if the drug cassette 8 is removed from the support base 7 immediately after a signal is input to the electronic paper, power is supplied to the electronic paper from the battery (or capacitor), and the display details can be rewritten. Note that the drug cassette 8 can be removed from the support base 7 by operating the cassette lock part 14 and cancelling the locked state with a prescribed amount of time required from the startup to completion of display data input. The time until the lock is cancelled in this case may be stored in memory by a memory means (not illustrated) on the device main body 1 side in advance.

In this manner, according to the drug cassette 8 of the above-described configuration, even if electronic paper is being used, if display data is input, the drug cassette 8 can be immediately removed from the support base 7, and work to replenish the drugs or the like can be performed. When the drug cassette 8 is removed from the support base 7, the electronic paper consumes zero electric power, and therefore even with a battery (or capacitor), the desired display data can be displayed without any problem. Moreover, the user can advance with work to replenish the relevant drugs in accordance with the displayed details.

As shown in FIG. 6, the first rotating shaft 63, which has one end fixed to the first driven gear 61 and the other end fixed to a third driving gear 62, and the second rotating shaft 66, which has one end fixed to the second driven gear 64 and the other end fixed to a fourth driving gear 65 (hypoid gear), are respectively supported in a rotatable manner at the back surface side of the cassette bottom part 54. Note that the top surface of the cassette bottom part 54 is covered by a cover body (not illustrated) having a roughly C-shape.

The cassette front end part 55 has a first housing recess part 67 linked with a second housing recess part 68 configuring the corners at both sides of the front end of the drug cassette 8, and is fixed to the cassette bottom part 54. A screw shaft 70 for driving the height regulator 69 is rotatably supported at the first housing recess part 67. A first shaft member 72 for driving the width regulator 71 is arranged at the second housing recess part 68.

Figure 8:
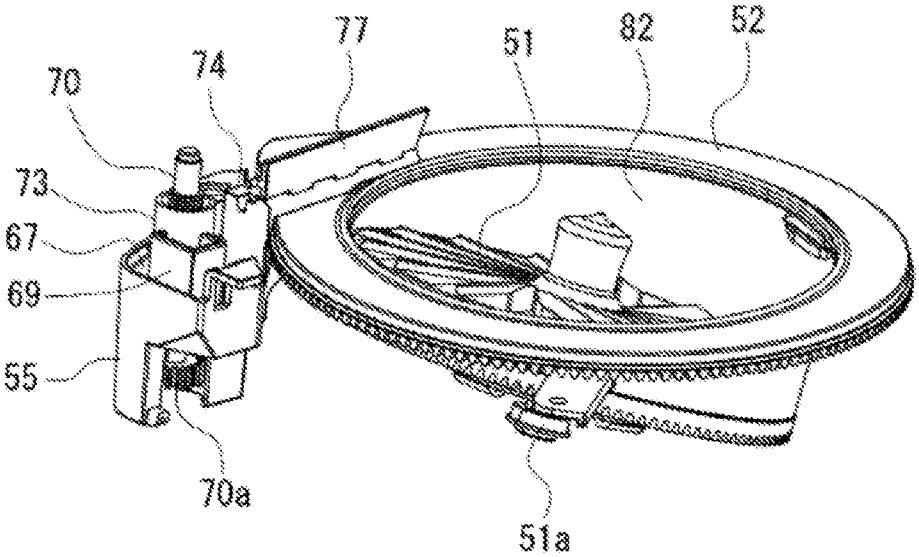
FIG. 8 is a perspective view showing the first rotating body, second rotating body and height regulator of FIG. 6.
Figure 9:
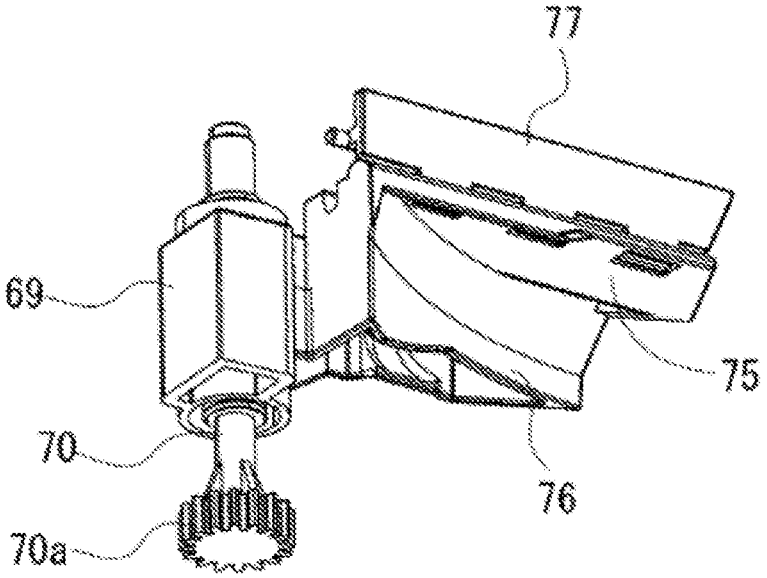
FIG. 9 is a perspective view showing the height regulator of FIG. 8 as viewed from a different angle.

As shown in FIG. 8 and FIG. 9, the height regulator 69 is provided with a cylinder part 73, and a height regulation unit 74 extending from this cylinder part 73. A female screw that is screwed together with a male screw formed at the outer circumferential surface of the screw shaft 70 is formed at the cylinder part 73, and is positioned inside the first housing recess part 67 of the cassette front end part 55. The height regulation unit 74 has a first guide surface 75 arranged at a desired spacing with respect to the top surface of the second rotating body 52, and a second guide surface 76 that configures a part of the outer peripheral surface of the drug conveying path in the circumferential direction through the second rotating body 52. The spur gear 70*a* is integrated at the lower end part of the screw shaft 70, and meshes with the first spur gear 19 of the support base 7 side. Through this, the drive power from the first motor 12 is transmitted to the screw shaft 70, the position at which the male screw and the female screw of the cylinder part 73 are screwed together changes, and the height regulator 69 moves up and down. Moreover, the position of the first guide surface 75 is adjusted with respect to the top surface of the second rotating body 52. As a result, the height of drugs conveyed in the circumferential direction by the second rotating body 52 is regulated by the height regulator 69. Furthermore, an auxiliary piece 77 is attached at the top surface of the height regulation unit 74 in a manner that allows rotation centered on a support shaft. The auxiliary piece 77 is biased by a spring (not illustrated) provided at the support shaft such that it stands upright from the top surface of the height regulation unit 74. In this manner, if the height regulator 69 is lowered, the auxiliary piece 77 is made to stand upright by the biasing force of the spring, the gap that is generated between the top surface of the height regulation unit 74 and the bottom surface of the lid body 53 is covered, and the movement inward of drugs can be prevented.

Figure 10A:
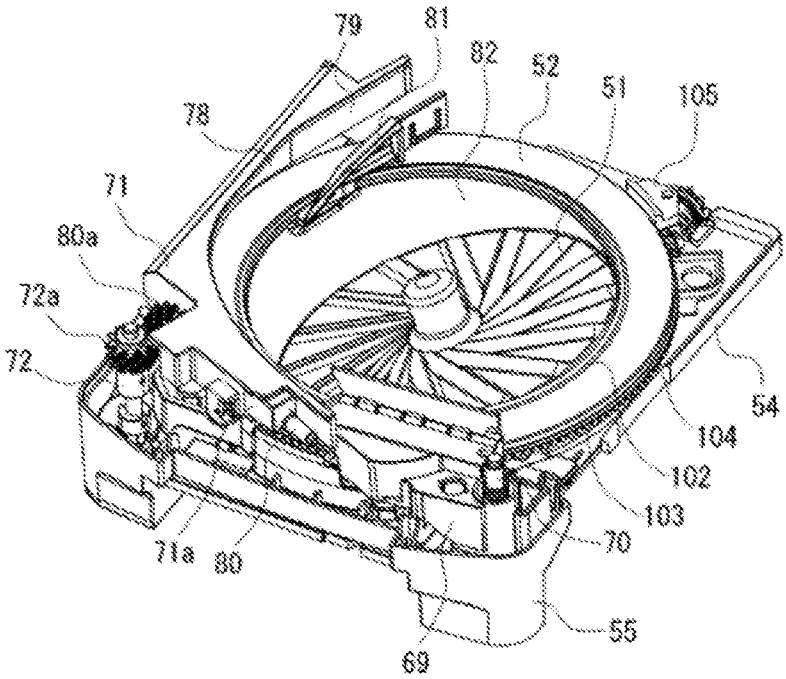
FIG. 10A is a perspective view of a state with the lid body and cassette torso removed from the drug cassette shown in FIG. 3A and the width regulator moved to a narrow width position.
Figure 10B:
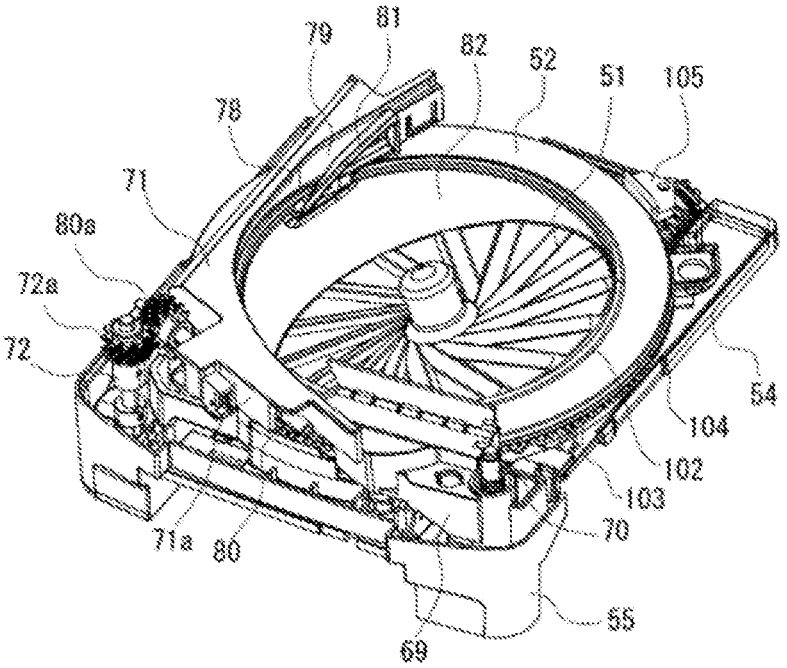
FIG. 10B is a perspective view with the width regulator moved to a wide width position.

As shown in FIG. 10A-10B, the width regulator 71 has a first guide surface 78 gradually curved to the outer diameter side along the outer circumference of the second rotating body 52, and a flat second guide surface 79 that is a continuation of the first guide surface 78. The second shaft member 80 is arranged at the outer diameter side of the first guide surface 78, and has a driven gear 80*a*, which meshes with the driving gear 72*a* provided at the upper end part of the first shaft member 72, provided at one end part thereof. At the other end side of the second shaft member 80, a male screw, which screws into the female screw of a female screw member 71*a* integrated with the width regulator 71, is formed. Moreover, when the first shaft member 72 rotates in the forward and reverse directions, the second shaft member 80 rotates via the driving gear 72*a* and the driven gear 80*a*, and the width regulator 71 moves back and forth via the female screw member 71*a* between the wide width position shown in FIG. 10A and the narrow width position shown in FIG. 10B. Note that the top surface of the width regulator 71 is covered by a protective cover (not illustrated) along with the driving gear 72*a* and the driven gear 80*a*.

As shown in FIG. 6, the cassette torso 56 is in a rectangular frame body shape, and the front end side has respective housing parts formed with each of the housing recess parts 67 and 68 of the cassette front end part 55. Furthermore, at the inner circumferential side of the cassette torso 56, an inner wall 56*a*, which configures a part (approximately half) of the inner circumferential surface along the outer circumferential edge of the second rotating body 52, is formed. A discharge guide piece 81 (see FIG. 10A-10B) is attached to one end part of the inner wall 56*a* to guide drugs conveyed by the second rotating body 52 to the hopper 47.

The cylindrical body 50 has an upper end opening part along the inner circumferential edge of the second rotating body 52, and extends to the downward side. The lower end opening part of the cylindrical body 50 is cut at an incline tailored to the inclination angle of the first rotating body 51. A drug housing part 82 (see FIG. 8) capable of housing drugs is formed by the inner circumferential surface of the cylindrical body 50 and the top surface of the first rotating body 51.

Figure 11:
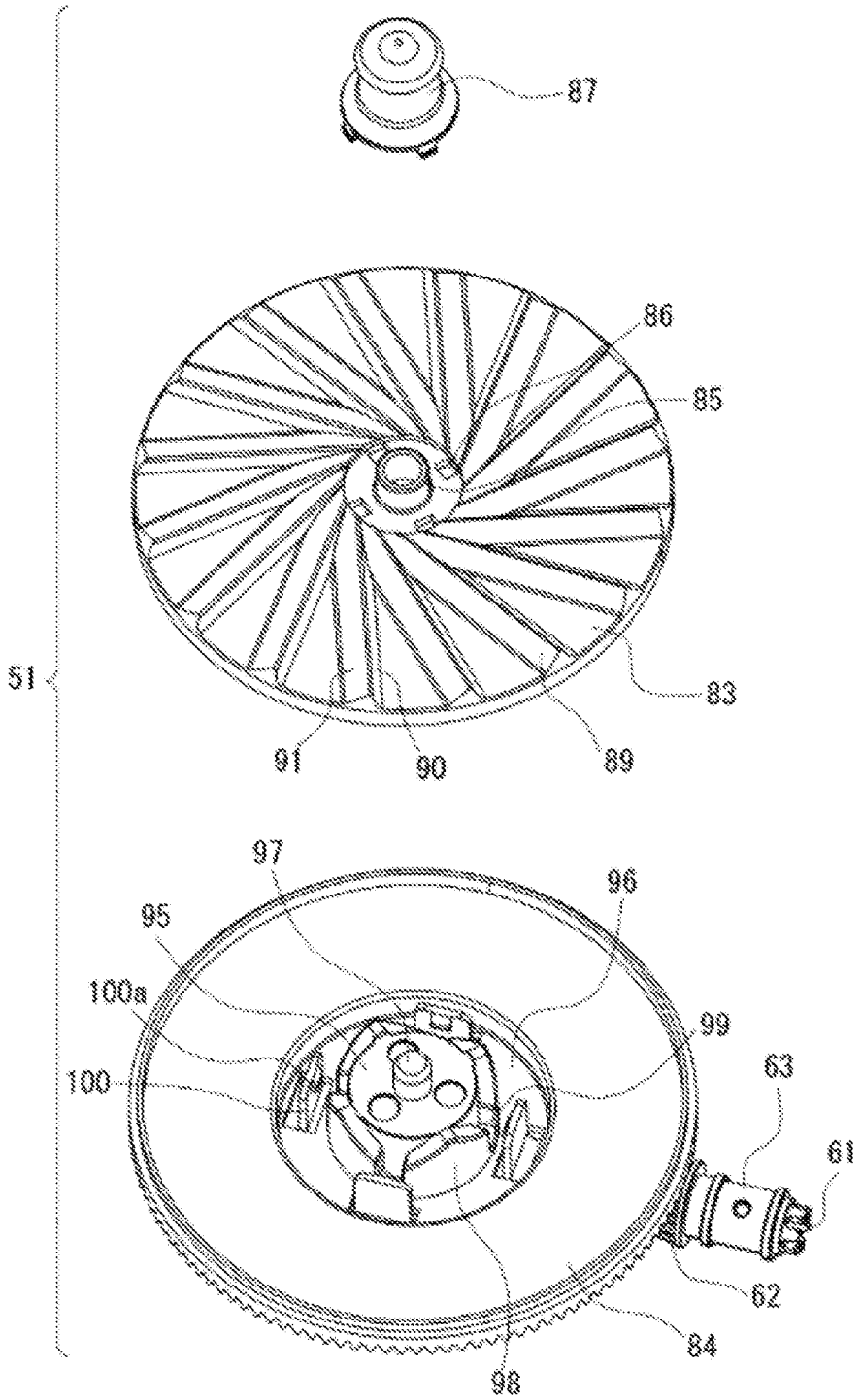
FIG. 11 is an exploded perspective view showing the first rotating body of FIG. 10A-FIG. 10B as viewed from above.
Figure 12:
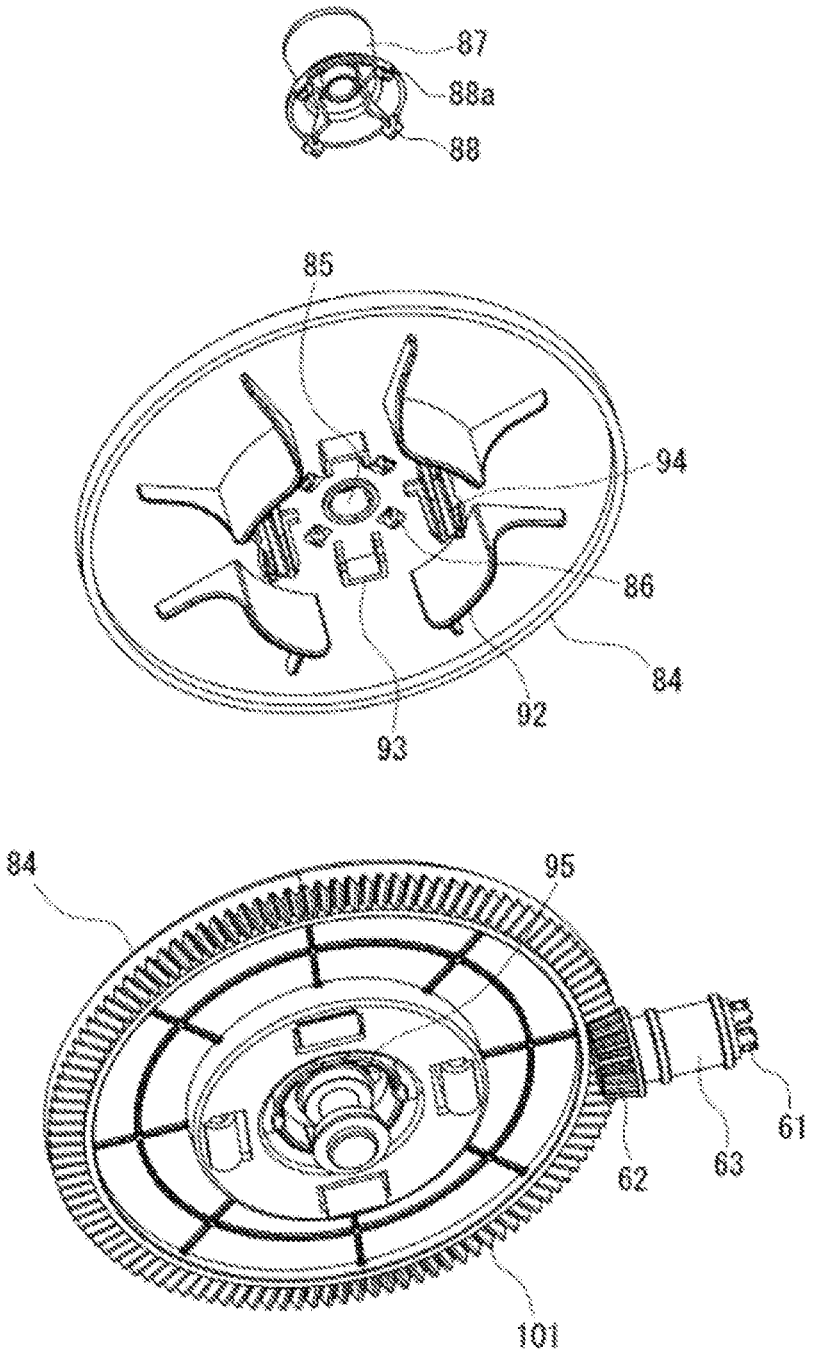
FIG. 12 is an exploded perspective view showing FIG. 11 as viewed from below.

As shown by FIG. 11 and FIG. 12, the first rotating body 51 is disk shaped, and is configured of a top surface part 83 and a bottom surface part 84. Furthermore, the first rotating body 51 is arranged at the lower end opening part of the cylindrical body 50, and is tilted with respect to the horizontal surface.

An upper cylinder part 85 is formed at the center of the top surface of the top surface part 83, and through holes 86 are formed at four places around the upper cylinder part 85. The upper cylinder part 85 is covered by a cap 87. Leg parts 88 are formed at the cap 87 at four places equally spaced from the lower opening part. The leg parts 88 are inserted into each of the through holes 86, and a claw part 88*a* formed at the tip end of each of the leg parts 88 is locked by locking claws of a later-described locking piece 100. A plurality of ridges 89 are formed around the through holes 86 and extend from a portion adjacent to the through holes 86 toward the outer diameter side. Each of the ridges 89 is inclined to the side opposite the rotational direction of the first rotating body 51 with respect to a straight line extending from the rotational center of the first rotating body 51 in the radial direction. Moreover, each of the ridges 89 has a first inclined surface 90 projecting from the top surface of the top surface part 83, and a second inclined surface 91 inclined in the rotational direction so as to gradually approach the top surface of the top surface part 83. The inclination angle of the first inclined surface 90 with respect to the top surface of the top surface part 83 is set so as to be sufficiently larger than the inclination angle of the second inclined surface 91. The first inclined surface 90 may also be configured with a surface that is perpendicular with respect to the top surface of the top surface part 83. Through this, when the first rotating body 51 rotates, drugs are pressed by the second inclined surface 91 and moved in the rotational direction. Because the drugs are pressed by the second inclined surface 91, the component of force in the rotational direction is not very large, and an appropriate amount is smoothly conveyed in the rotational direction. Furthermore, because the ridges 89 extend at an incline toward the side opposite the rotational direction, the drugs are moved to the outer diameter side as well, and are transferred to the top surface of the second rotating body 52.

Leg parts 92 arranged at four places equidistantly in the circumferential direction, and first projection parts 93 and second projection parts 94 arranged to the inside of the leg parts 92 are formed at the bottom surface of the top surface part 83. The leg part 92 is reinforced by both end parts extending to the outer diameter side. The first projection parts 93 are arranged at two places at symmetrical positions centered on the rotational center of the first rotating body 51. The second projection parts 94 have a projection dimension that is larger than that of the first projection parts 93, and are arranged between the first projection parts 93.

A lower cylinder part 95 for which the top surface is closed is formed at a center of the bottom surface part 84, and the rotating shaft 51*a*, which is rotatably supported at the bearing part 59 of the cassette bottom part 54 from the lower opening part, is linked and integrated.

A circular shaped recess part 96 is formed at a center part of the top surface of the bottom surface part 84, and the leg parts 92 of the top surface part 83 are arranged at the outer circumferential side thereof. Moreover, the lower cylinder part 95 projects at the center part of the bottom surface of the recess part 96, and a support shaft 97 is formed at the center part of the top surface thereof. The support shaft part 97 is disposed at the upper cylinder part 85 of the top surface part 83, and rotatably supports the top surface part 83. Moreover, mountain-shaped parts 98 and support recess parts 99 are alternatingly formed in the circumferential direction at the outer circumferential surface of the shaft part 97. The first projection parts 93 abut and are arranged at the inclined portion of adjacent mountain-shaped parts 98 (upper side of the support recess part 99), and the second projection parts 94 are arranged at the support recess parts of the remaining two places. Through this, the top surface part 83 and the bottom surface part 84 rotate in an integrated manner. Of course, if an unreasonable load is acted on the top surface part 83 and rotation is hindered, the second projection parts 94 come off from the support recess part 99, the top surface part 83 rotates with respect to the bottom surface part 84, and damage to the first rotating body 51 is prevented. Moreover, locking pieces 100 project at four places in an equidistant manner around the shaft part 97. A locking claw 100*a* is formed at the tip end of the locking piece 100 at the inside, and locks the claw part 88*a* formed on the leg part 88 of the cap 87.

A first driven gear 101 is formed at the outer peripheral edge of the bottom surface of the bottom surface part 84. The third driving gear 62 of the first rotating shaft 63 meshes with the first driven gear 101, and drive power of the third motor 30 is transmitted from this first rotating shaft 63 via the first driving gear 35 of the support base 7 side.

As shown in FIG. 6 and FIG. 10A-10B, the second rotating body 52 has a ring shaped body, which is arranged at the outer circumferential side of the upper opening part of the cylindrical body 50 and has a prescribed width in the radial direction. A ring shaped projection 102 projecting upward is formed at the inner circumferential edge of the second rotating body 52. The height of the ring shaped projection 102 is such that movement of drugs from the first rotating body 51 can be performed smoothly, and such that dropping to the inside by conveyance of the drugs through rotation of the second rotating body 52 can be suppressed. Furthermore, a second driven gear 103 is formed in the circumferential direction at the bottom surface of the second rotating body 52. The fourth driving gear 65 meshes with the second driven gear 103 such that drive power from the fourth motor 31 can be transmitted.

A step part 104 is formed at the outer circumferential edge of the second rotating body 52. The step part 104 is such that upward floating due to the presser piece 105 attached to the cassette torso 56 arranged above the second rotating body 52 can be prevented. The step part 104 is positioned at the outer diameter side of the position where the inner wall 56*a* of the cassette torso 56 is arranged. Therefore, drugs conveyed along the top surface of the second rotating body 52 are moved to the step part 104 and do not become caught between the presser piece 105, and the top surface of the second rotating body 52 is also not damaged. Furthermore, the presser piece 105 is arranged above the fourth driving gear 65. Through this, upward movement of the portion on which the most force acts can be reliably suppressed. Moreover, play, positional deviation, and the like after the unit has been disassembled, cleaned, and then reassembled can be prevented.

Note that the second rotating body 52 may also be set such that it rotates at a higher speed than the first rotating body 51. Through this, the spacing between drugs moved from the first rotating body 51 to the second rotating body 52 can be widened, and erroneous detection of the number of drugs that have been discharged can be prevented.

The lid body 53 is attached such that it is capable of rotating centered at one side part of the cassette torso 56. An auxiliary panel that covers the top surface of the width regulator 71 is rotatably attached to the rotating center of the lid body 53.

According to the drug cassette 8 of the above-described configuration, a compact configuration can be achieved by effectively utilizing the dead space of the four corners formed in the cassette main body 49. More specifically, the first rotating shaft 17 for driving the height regulator 69 and the first motor 12 for rotating this first rotating shaft 17 are arranged at one of the corners at the front surface side. In addition, the second rotating shaft 22 for driving the width regulator 71 and the second motor 13 for rotating this second rotating shaft 22 are arranged at the other corner. Furthermore, the third motor 30 for rotating the first rotating body 51, the fourth motor 31 for rotating the second rotating body 52, and the like are arranged at one corner at the back surface side, and the hopper 47 for drug discharge is arranged at the other corner at the back surface side.

Moreover, the drug cassette 8 of the above-described configuration can be disassembled and cleaned (washed for example). More specifically, the drug cassette 8 is configured such that the cassette torso 56 can be removed from the cassette bottom part 54, and the height regulator 69, the width regulator 71, the first rotating body 51, and the second rotating body 52 can be removed. The height regulator 69 can be removed together with the first rotating shaft 17 from the cassette front end part 55. The width regulator 71 can be removed together with the second shaft member 80 from the cassette front end part 55. The first rotating body 51 and the second rotating body 52 can be easily removed by merely removing the cover body from the cassette bottom part 54. Moreover, the first rotating body 51 can be disassembled into the top surface part 83 and the bottom surface part 84 by removing the cap 87.

In this manner, the parts of the drug cassette 8 that contact drugs can be disassembled and cleaned, and therefore if the type of drug is changed, or the like, contamination (mixing of different types of drugs) can be reliably prevented even if some of the drugs are damaged or dropped and powder is generated.

The control device 6 drives and controls each motor, the packaging unit 5, and the like based on prescription data received from a server (not illustrated) or the like and on detection signals from the discharge sensor 48.

Next, the operation of the drug packaging device having the above-described configuration is described. Here, the operation of dispensing drugs from the second drug feeder 3, which is a characteristic portion of the present invention, is described in detail, and a description of other operations is omitted.

If a drug is one with a low usage frequency, or the quantity of the drugs must be counted, the drugs are housed in the second drug feeder 3, and are dispensed and packaged (subjected to dividing and packaging processing) as follows.

Figure 13:
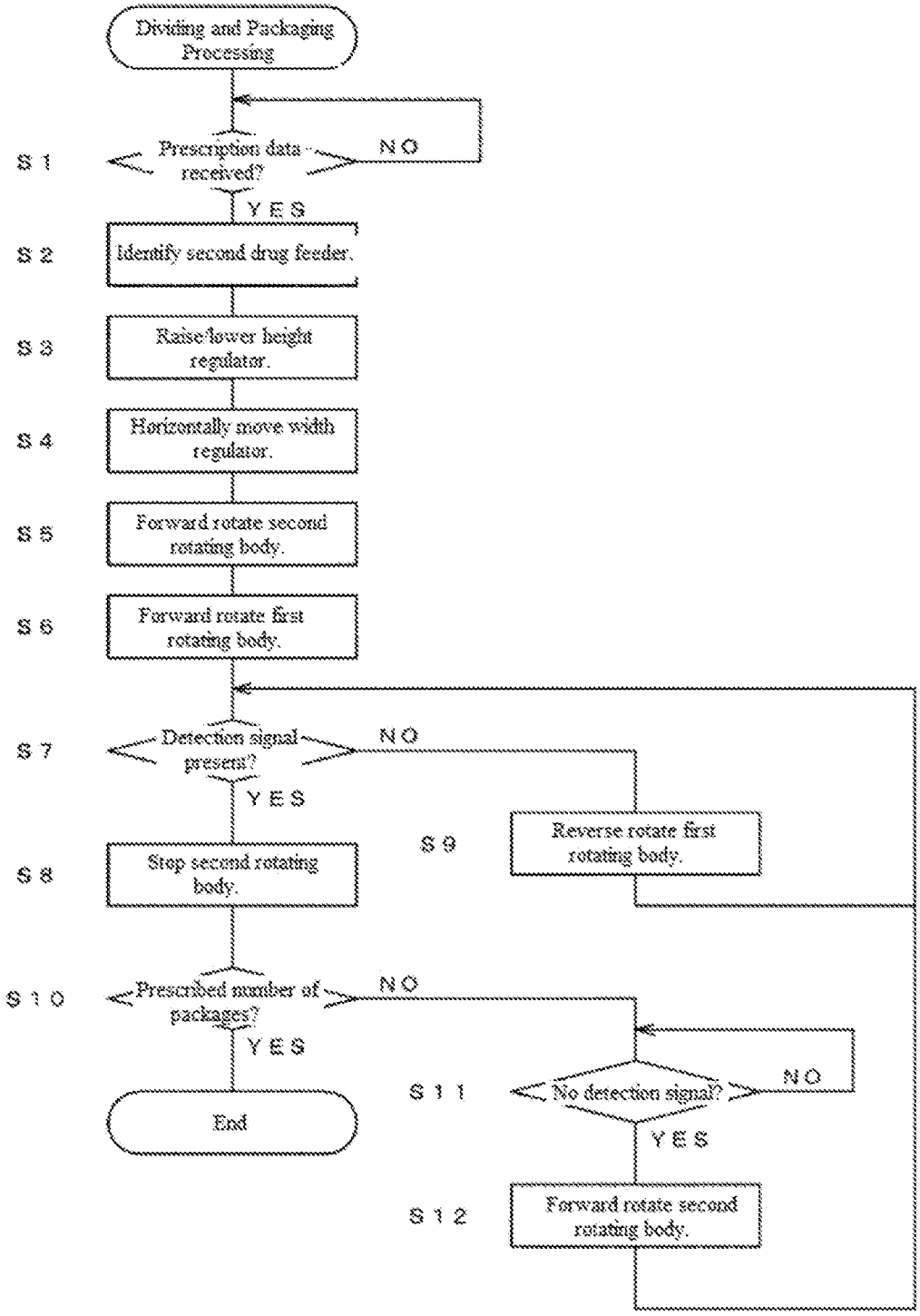
FIG. 13 is a flowchart showing dividing and packaging processing according to the present embodiment.

More specifically, as shown in FIG. 13, if prescription data is received (step S1), the second drug feeder 3 containing the drugs included in the prescription data thereof is identified (step S2). Namely, memory details from a data table of a memory means (not illustrated) are rewritten at any time based on whether each second drug feeder 3 is in a usage state or in an unused state. Furthermore, based on the drugs contained in the prescription data, the data table is referenced, and of the second drug feeders 3 in which the relevant drugs are housed, the second drug feeder 3 that is not being used at that time is identified. Note that the memory details in the data table for the identified second drug feeder 3 are rewritten at that time to indicate that the identified second drug feeder 3 is in a usage state.

Based on the drug information (shape, size, etc.), the height regulator 69 and the width regulator 71 are operated (steps S3 and S4). More specifically, the height regulator 69 is raised or lowered via the first rotating shaft 17 by driving the first motor 12, and a gap (height) that enables passage of only one drug is formed as the gap between the bottom surface of the height regulator 69 and the top surface of the second rotating body 52. The second rotating shaft 22 is rotated by driving the second motor 13, the width regulator 71 is moved horizontally via the second shaft member 80, and the position of the first guide surface 78 of the width regulator 71 is adjusted. Through this, the gap in the radial direction from the inner circumferential edge of the second rotating body 52 to the first guide surface 78 is adjusted to a dimension that allows movement of only a single drug.

Furthermore, the fourth motor 31 is driven to begin forward rotation of the second rotating body 52 (step S5), and the third motor 30 is driven to begin forward rotation of the first rotating body 51 (step S6). Through the rotation of the first rotating body 51, the drugs contained in the drug cassette 8 are subjected to frictional resistance from the second inclined surface 91 of the ridges 89 formed at the top surface of the first rotating body 51, and are moved in the rotational direction. Furthermore, as described above, the ridges 89 are formed from the inner diameter side to the outer diameter side in a manner which inclines to the opposite direction of the direction of rotation with respect to a straight line towards the radial direction from the rotating center of the first rotating body, and therefore the drugs easily move to the outer perimeter side as well. Through this, drugs on the first rotating body 51 move over the ring shaped projection 102 of the second rotating body 52, and move to the top surface of the second rotating body 52. Drugs that have moved to the top surface of the second rotating body 52 are conveyed in the rotational direction in association with the rotation of the second rotating body 52, and because of the height regulator 69 and the width regulator 71, only one drug is moved to the hopper 47 at the discharge side.

Drugs that have been moved to the hopper 47 are discharged one at a time to the hopper 47 and are guided to the packaging unit 5. Drugs discharged to the hopper 47 are detected by the discharge sensor 48. If a drug is detected by the discharge sensor 48 within a prescribed amount of time from the startup of rotation of the first rotating body 51 and the second rotating body 52 (step S7: YES), then the rotation of the second rotating body 52 is stopped (step S8). Incidentally, as described previously, drugs that can be detected by the discharge sensor 48 are drugs that are in a state of beginning to reliably drop from the second rotating body 52 such as a tilted drug. Accordingly, by stopping the rotation of the second rotating body 52 in this state, drugs can be reliably discharged only one at a time.

Furthermore, if the prescribed number of packages as noted by the prescription data has not been reached (step S10: NO), a decision is made as to whether the input of the detection signal from the discharge sensor 48 has disappeared or not (step S11). If the input of the detection signal from the discharge sensor 48 has disappeared (step S11: YES), rotation of the second rotating body 52 is resumed (step S12). Through this, rotation of the second rotating body 52 can be resumed after confirming that only a single drug was discharged based on the detection signal of the discharge sensor 48. In other words, drugs can be reliably discharged one at a time. During this time, the packaging unit 5 is driven and controlled, and sequentially discharged drugs are packaged in single package portions.

Incidentally, if a drug is spherical, even if the first rotating body 51 is rotating, in some cases the drug will rotate on the second inclined surface 91 of the ridges 89 and will be unable to move to the second rotating body side. Moreover, a similar thing can occur when the drug is cylindrically shaped or elliptical. In this type of case, the drugs cannot be detected by the discharge sensor 48 even though the first rotating body 51 and the second rotating body 52 are rotating.

Therefore, if a drug cannot be detected by the discharge sensor 48 within a prescribed amount of time even though the first rotating body 51 and the second rotating body 52 are rotating (step S7: NO), the first rotating body 51 is temporarily rotated in reverse (step S9). Through this, a drug that was rotated there is pressed by the first inclined surface 90, which is more inclined than the second inclined surface 91. As a result, even if a drug is spherical for example, it can be moved smoothly to the second rotating body 52 side.

Next, if the prescribed number of packages as noted by the prescription have been packaged (step S10: YES), packaging processing by the second drug feeder 3 is ended.

Note that even if a drug is missing, similar to the previous description, the drug cannot be detected by the discharge sensor 48, but the matter of rotating the first rotating body 51 in reverse may be performed also for a case when a drug cannot be moved to the second rotating body 52 even if the shape of the drugs is spherical or the like, or a drug is not missing.

The present invention is not limited to the configuration described for the present embodiment, and various modifications may be made.

For example, with the above-described embodiment, a case was described that uses a second drug feeder 3 and packages drugs with a low usage frequency. However, the second drug feeder 3 thereof can also be used for a case in which the quantity of a drug is counted. In this case, a route which guides drugs discharged from the hopper 47 to the front side of the mounted drug cassette 8 and is separate from the discharge route to the packaging unit side, which is similar to the one described above, is formed, and drugs discharged from there may be collected in a vial bottle or the like. Moreover, this method can also be used when dispensing a prescribed quantity of drugs into a vial bottle.

Furthermore, with the above-described embodiment, a change to details displayed on the display panel 60 was performed based on the display data input from the packaging device main body side with the drug cassette 8 mounted to the support base 7, but the change may also be performed with the drug cassette removed from the support base 7. In other words, if the drug cassette 8 is equipped with a receiver such that it can wirelessly receive a control signal from the packaging device main body side, display information can be sent to the drug cassette 8 with the drug cassette 8 removed from the support base 7, and the display information can be reflected on the electronic paper using power from the rechargeable battery.

What is claimed is:

1. A drug cassette comprising:

a cylindrical body arranged in a cassette main body for accommodating drugs, a first rotating body arranged on a bottom surface side of the cylindrical body in the cassette main body, and capable of rotating around a first rotating shaft; and a second rotating body arranged on an outer periphery of an opening part of the cylindrical body in the cassette main body, and capable of rotating around a second rotating shaft; and a width regulator for regulating a transport width of drugs on the second rotating body, wherein a shaft member for moving the width regulator is disposed within the cassette main body and outside the cylindrical body, said shaft member is configured for obtaining a driving force from a motor located outside the cassette main body and transferring said driving force to the width regulator.

2. The drug cassette according to claim 1 further comprising:

a height regulator including an adjustable height regulation unit for regulating a transport height of drugs on the second rotating body, wherein a shaft for moving the adjustable height regulation unit is disposed within the cassette main body and outside the cylindrical body, said shaft is configured for obtaining a driving force from another motor located outside the cassette main body and transferring said driving force to the height regulator.

3. The drug cassette according to claim 2, wherein the width regulator and the height regulator are both removable from the cassette main body.

4. The drug cassette according to claim 1 further comprising:

a hopper for discharging the drugs to be conveyed by the second rotating body, wherein the hopper is arranged within the cassette main body and outside the cylindrical body.

5. The drug cassette according to claim 1, wherein the first rotating body comprises a plurality of ridges extending on a top surface from a rotating center side to an outer diameter side, and each of the plurality of ridges have an inclination angle of a second inclined surface of a rotational direction side that is smaller compared to an inclination angle of a first inclined surface of a reverse side of the rotation direction.

6. The drug cassette according to claim 1 further comprising:

a drug detection unit for detecting the drugs discharged to the outside by rotation of the second rotating body; and a control unit for temporarily rotating the first rotating body in reverse direction when drugs are not detected by the drug detection unit even though the first rotating body and the second rotating body are being rotated.

7. The drug cassette according to claim 1 further comprising a drug detection unit configured so as to be capable of detecting drugs tilted due to a center of gravity position being separated from the second rotating body.

8. The drug cassette according to claim 7, wherein a step part is formed on an outer peripheral edge of the second rotating body; and wherein a presser piece for pressing the step part is provided.

9. A drug packaging device including the drug cassette according to claim 1 further comprising:

a support base for mounting removably the drug cassette, wherein four separate motors are set on said support base for generating separate driving forces to move the width regulator radially, to move the height regulator vertically, and to rotate the first rotating body and the second rotating body in both forward and reverse directions; and a packaging unit for packaging drugs discharged from the drug cassette.

* * * * *